United States Patent [19]

Weissman

[11] 3,936,913

[45] Feb. 10, 1976

[54] CLIP FOR T-BAR CEILING STRUCTURES

[76] Inventor: Sydney Joseph Weissman, 49 Apollo Drive, Don Mills, Ontario, Canada

[22] Filed: Apr. 7, 1975

[21] Appl. No.: 565,504

[52] U.S. Cl. ..... 24/73 C; 248/228; 248/317

[51] Int. Cl.[2] ..... A44B 21/00; E04G 17/18

[58] Field of Search ..... 248/72, 228, 317; 24/259 FC, 261 C, 261 B, 73 C, 81 C, 73 B; 52/489

[56] References Cited

UNITED STATES PATENTS

| | | | |
|---|---|---|---|
| 250,428 | 12/1881 | Duggan | 24/259 FC |
| 499,549 | 6/1893 | Hunter et al | 24/81 C UX |
| 506,958 | 10/1893 | Walden | 24/73 C UX |
| 1,419,806 | 6/1922 | Birch | 248/228 |
| 1,703,008 | 2/1929 | Justice | 24/261 C UX |
| 3,029,055 | 4/1962 | Smith | 248/228 |
| 3,601,862 | 8/1971 | Hargadon | 24/73 B |
| 3,630,554 | 12/1971 | Cherniak | 248/317 X |
| 3,739,599 | 6/1973 | Melone | 24/261 C X |

*Primary Examiner*—Donald A. Griffin

*Attorney, Agent, or Firm*—Rogers, Bereskin & Parr

[57] ABSTRACT

A clip for use in suspending an article from a T-bar ceiling structure is described. The clip is made of a single length of rigid wire shaped to define an upper portion for engagement with the bottom limb of the T-bar, and a lower portion of inverted triangular shape for engagement by an article to be suspended from the T-bar.

5 Claims, 5 Drawing Figures

CLIP FOR T-BAR CEILING STRUCTURES

This invention relates to clips for use in suspending articles from T-bar ceiling structures.

As is well known, a T-bar ceiling structure is made up of a plurality of elongate members of inverted T-shape in cross-section (T-bars) arranged in a grid pattern. Each T-bar has an upright stem and a bottom limb defining oppositely directed lateral portions. A plurality of ceiling tiles are supported on the said oppositely directed portions of the bottom limbs of the T-bars to form the surface of the ceiling. It is also known to provide clips which can be fitted to the T-bars for the purpose of suspending relatively lightweight articles such as lights, signs, advertising displays and the like.

An object of the present invention is to provide a simple, relatively light-duty clip for this purpose.

According to the invention, the clip is symmetrical about a longitudinal line of symmetry and is made of a single length of rigid wire shaped to define an upper portion for engagement with a T-bar, and a lower portion for engagement by an article to be suspended from the T-bar. The lower portion of the clip defines the general shape of an inverted isosceles triangle arranged with its base transverse to said line of symmetry. Said portion includes two inclined sections angularly disposed with respect to one another and extending along the inclined sides of said triangle, and two transverse sections extending generally parallel to one another generally along the base of the triangle and each joined at one end to a respective one of said inclined sections. The upper portion of the clip defines two angled sections each joined at one end to the opposite end of a respective one of said transverse sections. Said angled sections include respective portions at the ends of said lengths of wire, said end portions being positioned generally parallel to and closely adjacent said line of symmetry and projecting outwardly of the clip. The angled sections also include respective rectilinear portions which extend outwardly from said end portions transverse to said line of symmetry. When the clip is fitted to a T-bar in use, said end portions lie against respectively opposite sides of the T-bar and said rectilinear portions extend across the upper surfaces of said lateral portions of the T-bar.

The invention will be better understood by reference to the accompanying drawings in which.

Figure 1:
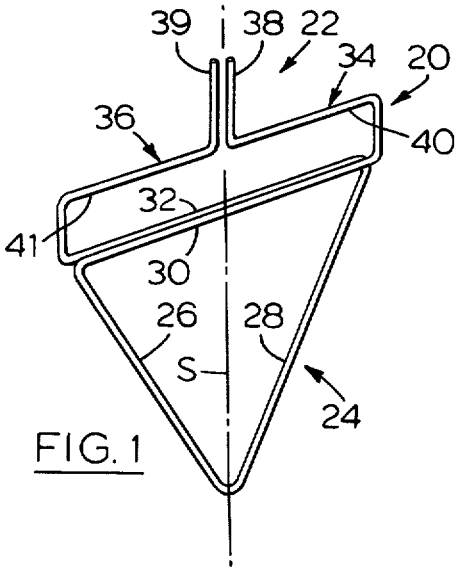
FIG. 1 is a perspective view of a clip according to the invention.
Figure 2:
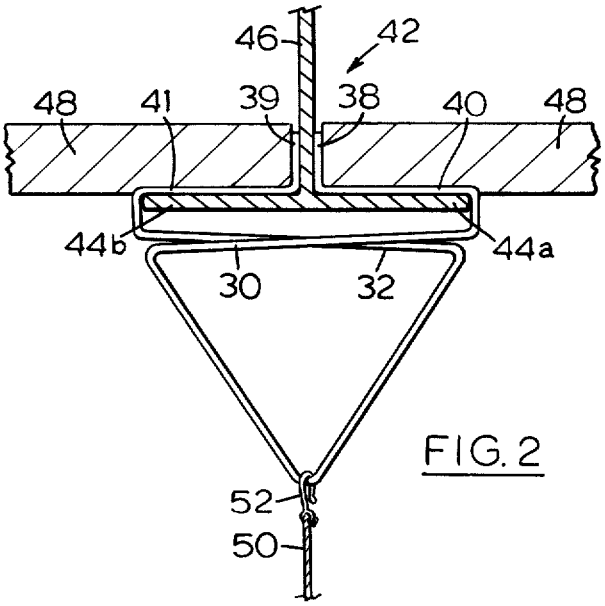
FIG. 2 is a vertical sectional view through part of a T-bar ceiling structure showing the clip of FIG. 1 in use.

Referring first to FIGS. 1 and 2, a clip according to the invention is generally indicated at 20 and is made of a single length of spring steel wire of circular cross-section. The wire is 0.041 inch in diameter and is tinned m.b. gauge. The clip is symmetrical about a longitudinal line of symmetry S (FIG. 1) and includes an upper portion 22 for engagement with a T-bar in use, and a lower portion 24 for engagement by an article to be suspended from the T-bar.

The lower portion 24 defines the general shape of an inverted equilateral triangle arranged with its base transverse to said line of symmetry S. In this embodiment, the sides of the triangle are approximately one inch in length. Portion 24 includes two inclined sections 26,28 which are angularly disposed with respect to said line of symmetry and which extend along the inclined sides of the triangle. Two transverse sections 30 and 32 extend generally parallel to one another and generally along the base of said triangle. Each of said sections 30, 32 is joined at one end to a respective one of said inclined sections 26, 28. In other words, the end of section 30 at the left hand end of said base of the triangle is joined to the upper end of the left hand inclined sections 26, and the end of the other section 32 at the right hand end of the base is joined to the upper end of the other inclined section 28.

The opposite ends of said sections 30 and 32 are joined to respective angled sections 34 and 36 of the upper portion 22 of the clip. The angled sections 34 and 36 and the transverse sections 30 and 32 co-operate to define a shape which conforms generally to the shape of the bottom limb of the T-bar to which the clip is to be fitted. Sections 34 and 36 include upstanding end portions 38 and 39 and adjacent respective rectilinear portions 40, 41.

Referring now to FIG. 2, part of a T-bar ceiling is shown in vertical cross-section. A T-bar is indicated at 42 and includes a bottom limb 44 disposed generally horizontally, and a stem 46 which projects upwardly from the bottom limb 44 generally along the longitudinal median line of said limb. Ceiling tiles, part of two of which are visible at 48, rest on the upper surfaces of the oppositely directed portions 44a, 44b of said bottom limb 44 on opposite sides of the stem 46. The clip 20 is fitted to the T-bar 42 by lifting the tiles 48 and engaging the respective angled sections 34 and 46 of the upper portion of the clip over respectively opposite sides of the bottom T-bar limb 44. The said rectilinear portions 40, 41 extend transversely of the upper surfaces of said oppositely-directed portions **44*a*, 44*b* of said T-bar limb 44. The tiles are then replaced on top of the rectilinear portions of the angled sections 34 and 46. The inner edges of the tiles are located against the end portions 38 and 39 of the clip. Sometimes, it may be more convenient to engage the respective angled portions 34 and 46 of the clip with the T-bar one at a time. In this event, one of the tiles 48 is first lifted and the relevant angled portion 34 or 36 of the clip is engaged over one side of the bottom limb of the T-bar. The lifted panel is then replaced and the other panel is lifted while the other angled portion of the clip is engaged with the other side of the limb 44.**

In any event, it will be appreciated that the panels 48 tend to hold the clip in place on the T-bar. The panels 48 may be made of polystyrene or other material, the surface of which will be indented by the pressure of the tile against the angled sections of the clip. Such indentation will tend to assist in locating the clip. Accordingly, the clip will tend not to move along the T-bar. Twisting of the clip will also be resisted since any such movement would tend to cause the angled sections 36 and 34 to move apart due to the pressure between the side edges of the limb 44 of the T-bar and the adjacent portions of the clip. However, such movement of sections 34 and 36 apart is resisted by the inner edges of the tiles 48 bearing against the end portions 38 and 39 of the upper portion of the clip.

An article to be suspended from the clip is engaged with the lower portion 24. For example, as indicated in FIG. 2, the article may be suspended by a cord such as that indicated at 50 provided at its upper end with a hook 52 which is engaged with the lower portion 24 of the clip at the junction between the inclined sections 26 and 28.

It will be noted that the line of symmetry S (FIG. 1) of the clip extends through the junction between the inclined sections 26 and 28 of the lower portion 24 of the clip and through the stem 46 of the T-bar when the clip is in use. Further, the shape of the angled sections 34 and 46 of the upper portion of the clip is such that the weight of an article suspended from the clip is distributed across the oppositely-directed portions 44*a*, 44*b* of the bottom limb 44 of the clip. This weight is carried by the said rectilinear portions 40 and 41 of the angled portions 34 and 36 of the clip, which portions make line contact with the said upper surfaces of said oppositely-directed portions 44*a*, 44*b* of the bottom limb 44 of the clip. The weight of an article suspended from the clip therefore acts along the said line of symmetry and is equally distributed across the cross-section of the T-bar. This avoids distortion of the clip and uneven loading of the T-bar. It is, of course, to be understood that an article may be suspended from the clip other than in the manner illustrated in FIG. 2.

As has already been mentioned, the sections 30 and 32 of the clip are normally disposed generally parallel to one another. However, the weight of an article suspended from the clip tends to distort the clip so that the sections 30 and 32 adopt a crossed configuration as can be seen in FIG. 2. Where the article is comparatively light in weight, this distortion will be minimal. However, where heavier weight articles are to be suspended, the modification illustrated in FIG. 3 is preferably adopted.

Figure 3:
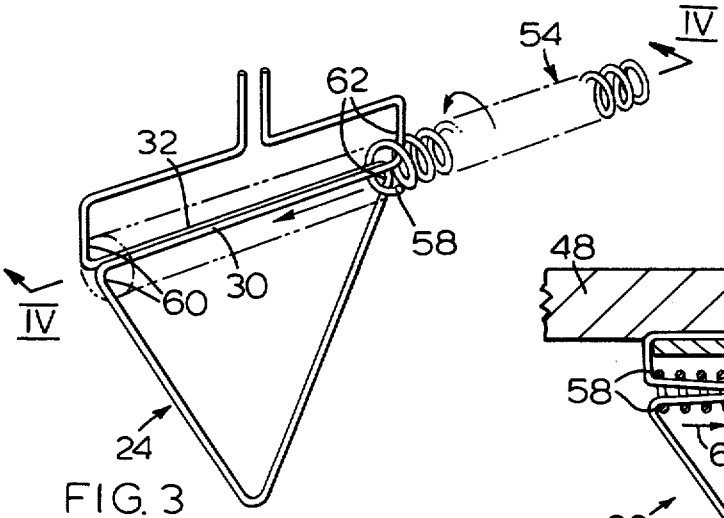
FIG. 3 is a view similar to FIG. 1 and illustrates how the clip of FIG. 1 may be modified by the addition of a spring.

Referring to FIG. 3, the clip itself is of the same form as that shown in FIGS. 1 and 2. However, the clip is modified by the addition of a compression spring 54 which is located around the sections 30 and 32 of the clip. The position of the spring when the clip is in use is indicated in chain dotted lines 56. The spring is fitted to the clip by engaging the end coil 58 of the spring around the sections 30 and 32 as indicated in FIG. 3 and rotating the spring to cause it to wind onto the sections. The spring is a helical compression spring and is of a length substantially equal to the length of the sections 30 and 32 so that the respective ends of the clip abut against parts of the clip indicated at 60 and 62 in FIG. 3. The spring may be dimensioned so that it is under slight compression at this time.

Figure 4:
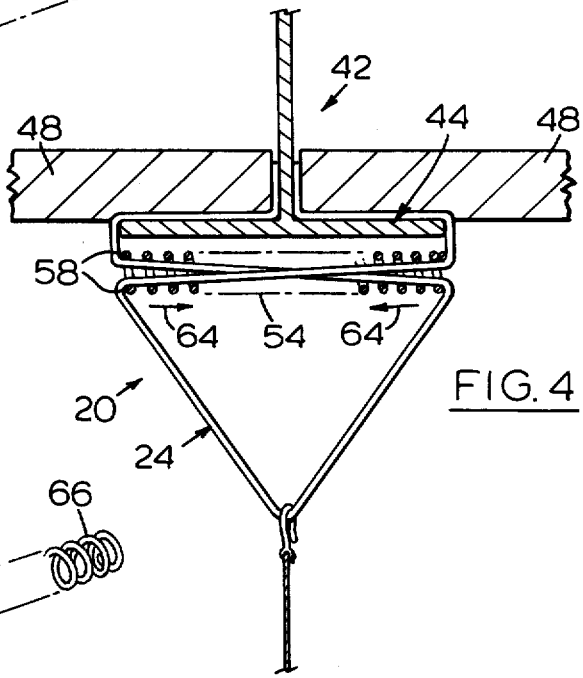
FIG. 4 is a vertical sectional view on line IV—IV of FIG. 3, showing the clip in use on a T-bar; and, FIG. 5 is a view similar to FIG. 3 and illustrates how an extra spring may be fitted to the clip.

In use, the spring 54 minimizes the extent to which the sections 30 and 32 of the clip can move out of parallel. FIG. 4 shows the clip in a loaded condition with the sections crossed to the maximum possible extent within the spring. It will be noted that the inner surfaces of the endmost coils of the spring 54 have been contacted by end portions of the sections 30 and 32 of the clip under the influence of the load on the clip. These endmost coils accordingly prevent the sections moving into positions in which they are crossed to a greater extent. The pressure exerted by the sections 30, 32 on the endmost coils of spring 54 tend to move the coils inwardly in the directions indicated by arrows 64 in FIG. 4. However, the spring tends to resist such compression, with the result that under normal loading, the endmost coils remain in their outermost positions and hold the clip sections 30 and 32 in the limit positions.

The intention is that the clip and spring will be sold together, but without the spring fitted to the clip. The clip can then be used alone for lightweight applications, or it can be fitted with a spring where heavy articles are to be suspended. Different strengths of spring may be provided to cater for different weight articles. Alternatively, to cater for different load requirements, several springs of the same strength may be supplied with the clip so that two or even more springs can be added to the clip to increase its load bearing capability, as will now be described.

Figure 5:
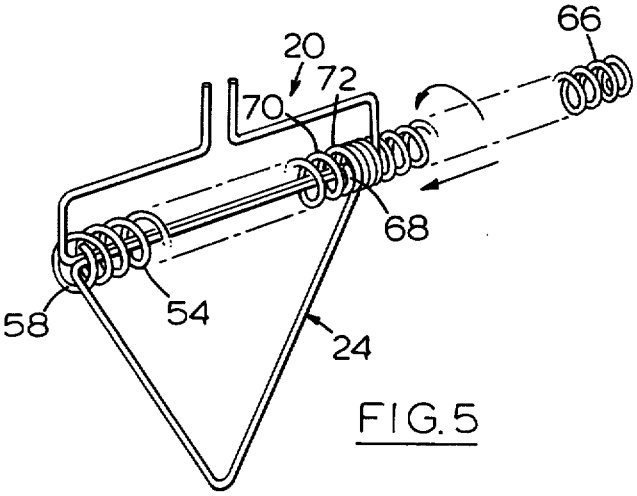

FIG. 5 shows the spring wire clip 20 of the previous embodiments fitted with the spring 54 of FIG. 3. An additional spring 66 similar to spring 54 is fitted to the clip so that the coils of spring 66 are located between the coils of spring 54. This second spring 66 is fitted in similar fashion to spring 54; that is, by being wound onto the clip. Spring 66 is positioned so that its leading end coil 68 is initially disposed between the two end coils 70 and 72 of spring 54. Spring 66 is then rotated as indicated by the arrow so that it is wound onto the clip sections 30 and 32 between the coils of spring 54. Obviously, the resistance of the two springs 54 and 66 to radial distortion and to compression is substantially greater than the resistance of spring 54 alone. Accordingly, when fitted with two springs, the clip has a substantially higher load bearing capability than when fitted with a single spring.

It will be appreciated from the foregoing description that the clip provided by the invention can be manufactured simply and inexpensively and can be readily fitted to and removed from a T-bar without the need for special tools. Further, the clip is of neat and unobtrusive appearance and yet can be used to support significant loads. Also, as has already been explained, the weight of an article suspended from the clip is equally distributed across the cross-section of the clip.

It will be appreciated that the preceding description applies to a specific form of clip and that modifications are possible within the broad scope of the invention. For example, in the embodiment described, the lower portion 24 of the clip is in the shape of an equilateral triangle. An equilateral triangle is a special form of isosceles triangle. The said lower portion 24 of the clip can define the shape of any isosceles triangle in which the equal sides form the inclined sections 26 and 28.

The specific sizes quoted above are given by way of example only and are not limitive of the scope of the invention. Further, the clip is not essentially made of spring wire. For example, the wire may be deformable to fit the clip to a T-bar. Further, the wire is not essentially of circular shape in cross-section. If the clip is made of flat section wire, the cross-section of the wire should preferably not be too wide.

With respect to the spring arrangements (FIGS. 3 to 5), where two or more springs are used, they may be arranged concentrically with respect to one another. The maximum number of springs which may be fitted to a single clip will be determined by the space available.

What I claim is:

1. A clip for use in suspending an article from a T-bar ceiling structure which includes a plurality of T-bars each having an upright stem and a bottom limb defining oppositely directed lateral portions, wherein the clip is symmetrical about a longitudinal line of symmetry and is made of a single length of rigid wire shaped to define an upper portion for engagement with one of said T-bars in use, and a lower portion for engagement by an article to be suspended from the T-bar, wherein the lower portion of the clip defines the general shape of an inverted isosceles triangle arranged with its base transverse to said line of symmetry and includes: two inclined sections angularly disposed with respect to said line of symmetry and extending along the inclined sides of said triangle; and two transverse sections extending generally parallel to one another generally along the base of the triangle and each joined at one end to a respective one of said inclined sections: and wherein the upper portion of the clip defines two angled sections each joined at one end to the opposite end of a respective one of said transverse sections, said angled sections including: respective portions at the ends of said length of wire, said end portions being positioned generally parallel to and closely adjacent said line of symmetry and projecting outwardly of the clip; and respective rectilinear portions which extend outwardly from said end portions transverse to said line of symmetry, whereby when the clip is fitted to a T-bar in use, said end portions lie against respectively opposite sides of the stem of the T-bar and said rectilinear portions extend across the upper surfaces of said lateral portions of the bottom limb of the T-bar.

2. A clip as claimed in claim 1, wherein the said rigid wire is made of spring steel and is of circular shape in cross-section.

3. A clip as claimed in claim 1, wherein the said lower portion of the clip defines the general shape of an equilateral triangle having sides of approximately one inch in length.

4. A clip as claimed in claim 1 in combination with a helical compression spring fitted around said transverse sections of the lower portion of the clip and of a length generally corresponding to the length of said sections, said spring serving to limit the extent to which said transverse sections can move apart in response to loading of the clip in use.

5. A clip fitted with a spring as claimed in claim 4, in combination with a further spring similar to said first mentioned spring and fitted around said transverse sections of the clip so that the coils of said further spring are located between the coils of the first-mentioned spring.

* * * * *